US006295754B1

(12) United States Patent
Otteman et al.

(10) Patent No.: US 6,295,754 B1
(45) Date of Patent: Oct. 2, 2001

(54) AIMING DEVICE WITH ADJUSTABLE HEIGHT MOUNT AND AUXILIARY EQUIPMENT MOUNTING FEATURES

(76) Inventors: Rodney H. Otteman, 17100 SW. Augusta La., Aloha, OR (US) 97006; Victoria J. Peters, 12592 NW. Timmerman, Forest Grove, OR (US) 97116; Gary R. Williams, 19151 Kantara Ct.; Wayne Perley, 650 SW. Schaeffer Rd., both of West Linn, OR (US) 97068

( * ) Notice: Subject to any disclaimer, the term of this patent is extended or adjusted under 35 U.S.C. 154(b) by 0 days.

(21) Appl. No.: 09/425,279

(22) Filed: Oct. 21, 1999

Related U.S. Application Data

(60) Provisional application No. 60/105,111, filed on Oct. 21, 1998.

(51) Int. Cl.[7] ..... F41G 1/46
(52) U.S. Cl. ..... 42/124; 42/111
(58) Field of Search ..... 33/245, 246; 42/100, 42/101, 103, 111, 112, 124, 148

(56) References Cited

U.S. PATENT DOCUMENTS

| | | | | |
|---|---|---|---|---|
| D. 248,309 | | 6/1978 | Weast | D22/7 |
| D. 290,709 | | 7/1987 | Hedrick | D16/44 |
| D. 331,443 | | 12/1992 | Bechtel | D22/109 |
| 3,737,232 | * | 6/1973 | Milburn, Jr. | 356/18 |
| 3,911,451 | * | 10/1975 | Vockenbuber | 354/79 |
| 3,974,585 | * | 8/1976 | Dunham | 42/1 S |
| 4,021,954 | * | 5/1977 | Crawford | 42/1 ST |
| 4,309,095 | * | 1/1982 | Buckley | 354/81 |
| 4,317,304 | * | 3/1982 | Bass | 42/1 ST |
| 4,328,624 | * | 5/1982 | Ross | 33/245 |
| 4,561,204 | * | 12/1985 | Binion | 42/1 ST |
| 4,677,782 | * | 7/1987 | Kaye et al. | 42/100 |
| 4,707,772 | * | 11/1987 | Jimenez et al. | 362/110 |
| 4,876,815 | * | 10/1989 | Terrill | 42/100 |
| 4,878,307 | * | 11/1989 | Singletary | 42/101 |
| 4,945,646 | * | 8/1990 | Ekstrand | 33/245 |
| 5,020,262 | | 6/1991 | Pena | 42/106 |
| 5,033,219 | * | 7/1991 | Johnson et al. | 42/103 |
| 5,134,798 | | 8/1992 | Lee | 42/100 |
| 5,406,733 | * | 4/1995 | Tarlton et al. | 42/101 |
| 5,428,915 | | 7/1995 | King | 42/101 |
| 5,787,630 | | 8/1998 | Martel | 42/101 |
| 5,806,228 | * | 9/1998 | Martel et al. | 42/101 |
| 5,867,915 | * | 2/1999 | McMillan | 33/245 |
| 5,887,375 | * | 3/1999 | Watson | 42/100 |
| 5,941,489 | * | 8/1999 | Fanelli et al. | 248/298.1 |
| 6,131,294 | * | 10/2000 | Jibiki | 33/245 |
| 6,154,971 | * | 12/2000 | Perkins | 33/265 |

* cited by examiner

*Primary Examiner*—Charles T. Jordan
*Assistant Examiner*—Michelle Thomson
(74) *Attorney, Agent, or Firm*—Stoel Rives LLP

(57) ABSTRACT

A telescopic sight is provided that includes an integral mounting bar for connection to a barrel of a firearm and integral auxiliary equipment mounting features for mounting auxiliary equipment onto the telescopic sight. The auxiliary equipment mounting features facilitate the mounting of multiple devices that allows for quickly alternating between different aiming devices or to simultaneously use multiple aiming devices. Clamp assemblies cooperate with the mounting bar to secure the telescopic sight to the firearm and provide adjustment of the height position of the telescopic sight. The clamp blocks are adapted to fit onto a mounting rail of a firearm. The mounting features are universal and require no post-mounting adjustment to accurately align the auxiliary equipment.

14 Claims, 6 Drawing Sheets

FIG. 1
(PRIOR ART)
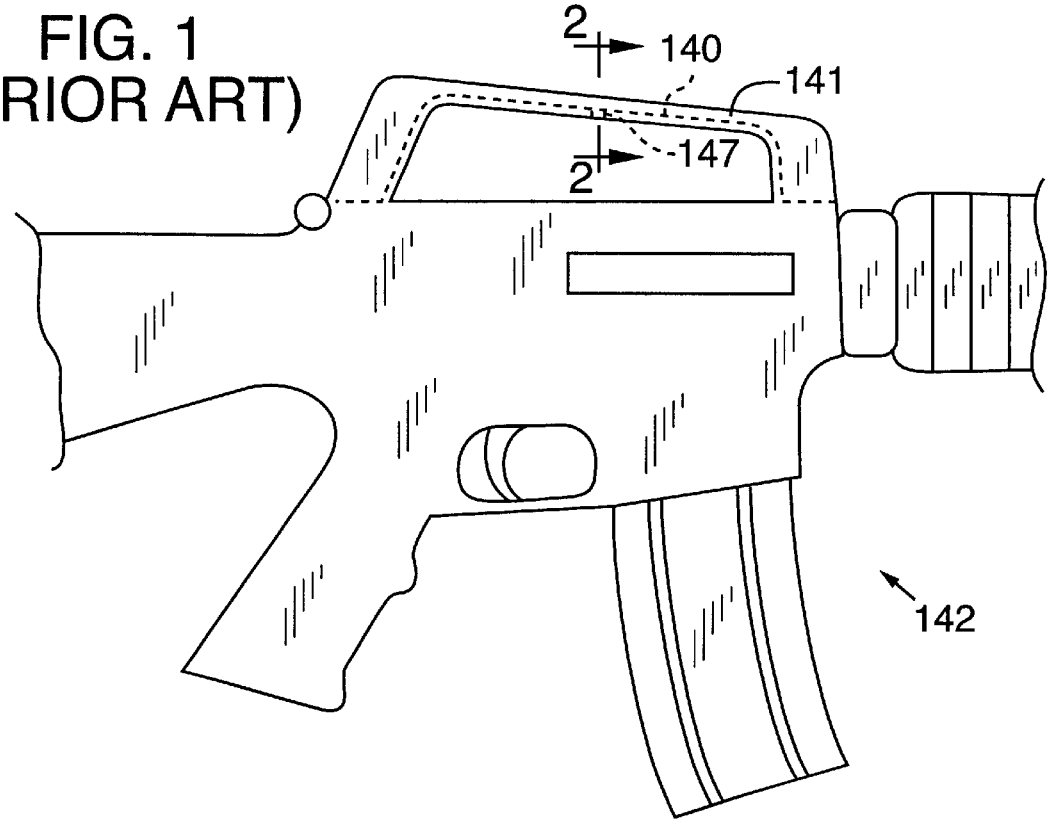
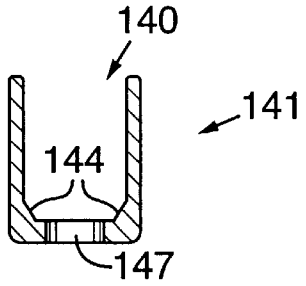
FIG. 2
(PRIOR ART)

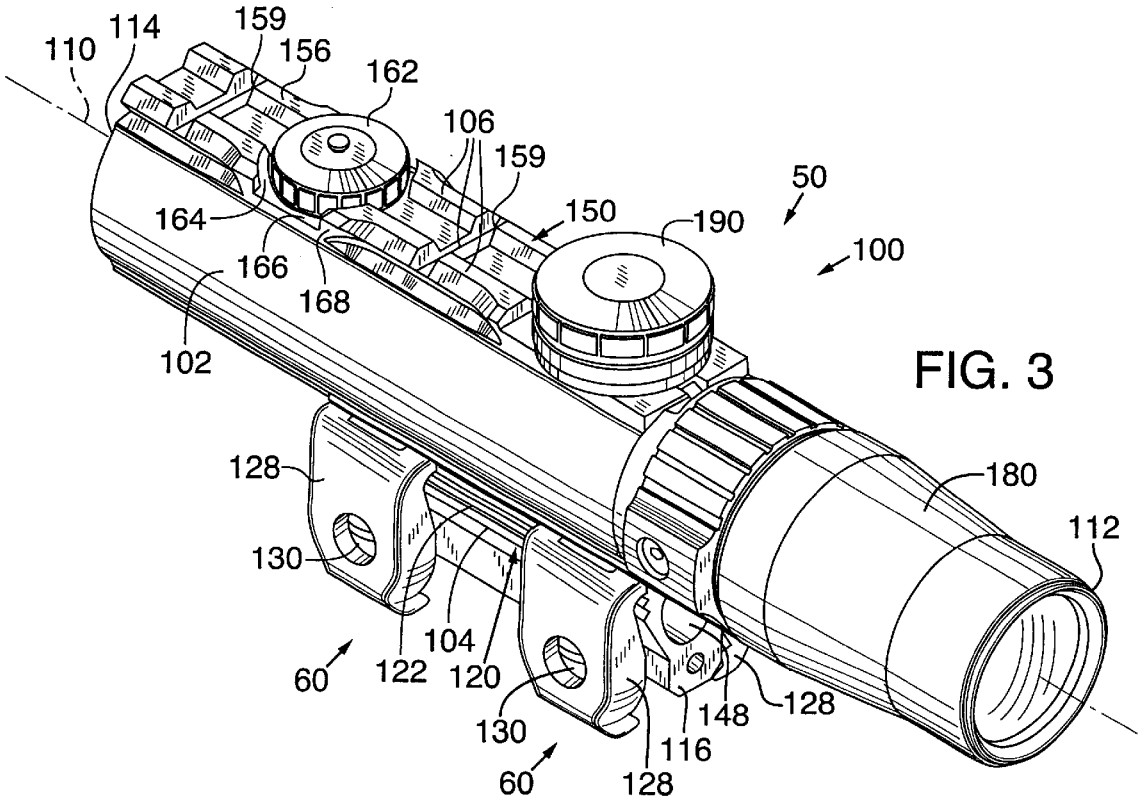
FIG. 3
FIG. 4
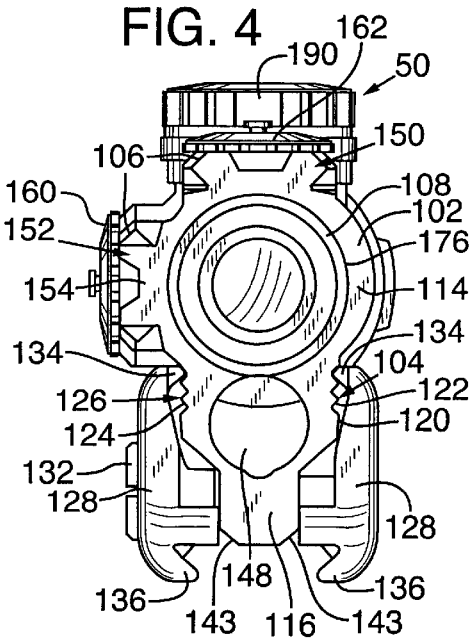
FIG. 5
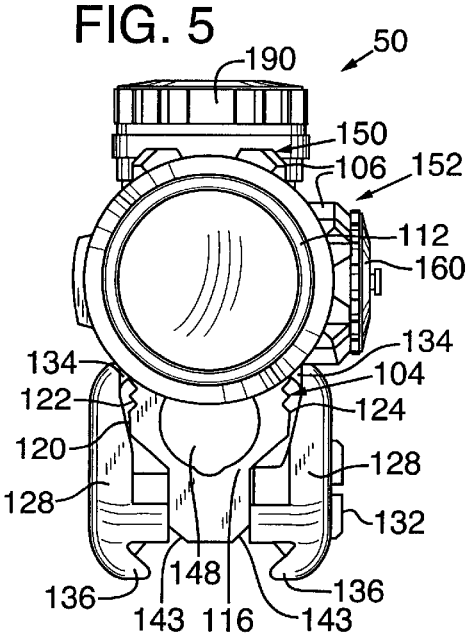

AIMING DEVICE WITH ADJUSTABLE HEIGHT MOUNT AND AUXILIARY EQUIPMENT MOUNTING FEATURES

RELATED APPLICATION

This application claims priority from Provisional Patent Application No. 60/105,111, filed Oct. 21, 1998.

TECHNICAL FIELD

The invention relates to telescopic sights and other aiming devices for firearms and the like and, in particular, to a telescopic sight with integral mounting features to allow for height adjustment to accommodate various head positions and for mounting auxiliary equipment on the telescopic sight.

BACKGROUND OF THE INVENTION

A telescopic sight is one type of aiming device that has long been used in conjunction with firearms such as rifles and handguns to assist a shooter in aiming the firearm. More recently, other aiming devices such as laser markers, range finders, and infrared imaging devices have been developed for use with firearms. These aiming devices are typically securely mounted to the firearm above a barrel or receiver of the firearm using a mounting rack or mounting rings. Some aiming devices, including telescopic sights, must be positioned at a particular distance from the eye of the shooter, known as the eye relief distance, to properly view the target through the aiming device. Once the aiming device is mounted to the firearm, fine adjustments are made to the mount, the aiming device, or both to accurately align the aiming device with the firearm. This fine tuning of the alignment is known as "sighting in." Because rifles are typically designed with mounting space sufficient for only one aiming device, the shooter is forced to choose one aiming device or to swap aiming devices in the field when needed. Each time aiming devices are swapped in the field, they must be sighted in to alleviate misalignment inherent in the mount's tolerances.

When used with a rifle, the telescopic sight is typically mounted at a fixed height above the barrel or receiver so that the shooter holding the rifle may easily view a target through the scope from the shooter's natural head position. Protective clothing and headgear, such as gas masks, bulletproof vests, and the like that are occasionally worn by the shooter, can change the shooter's natural head position and make it difficult to use the sight.

One conventional prior art device for mounting a telescopic sight to a rifle scope is shown and described in U.S. Pat. No. 5,035,487 issued to the assignee of the present invention. This mounting device includes a base unit securely mounted to the firearm in accurate alignment with the bore of the firearm and two split mounting rings for receiving a tubular housing of a rifle scope. The mounting rings each include a pin that extends from the rings below the telescopic sight for seating in one of a pair of receiving holes of the base unit for removably attaching the rings to the base unit. A locking lever locks the pins in the receiving holes. These devices do not accommodate the mounting of multiple aiming devices or other equipment to the firearm and do not allow any adjustment of the height of the telescopic sight above the firearm.

Another prior art type of mounting device is shown and described in U.S. Pat. Nos. D 269,989, D 269,988, and 4,328,624. This mounting device is known in the art as a WEAVER mount, after its original manufacturer, W. R. Weaver Company, El Paso, Tex. The WEAVER mount includes an elongate rail having a dovetail shaped cross section and multiple slots oriented transversely of the rail and spaced apart along the rail. Due to the WEAVER mount's widespread use in the industry and its ability to accommodate various types of aiming devices, it is considered a universal mount.

Yet another type of prior art mounting device having a dovetail rail is described in U.S. Military Standard No. MIL-STD-1913 (AR). This dovetail shaped mounting rail is known in the art as a Picatinny mount or Picatinny rail. As with the WEAVER mount, the Picatinny mount is a universal mount that provides a general purpose base for removably mounting different types of equipment to a firearm.

U.S. Pat. No. 4,707,772 describes a system for mounting a telescopic sight and a flashlight above a firearm. A pair of extension arms are substituted for a top portion of the split mounting rings of a conventional mount of the type shown in U.S. Pat. No. 5,035,487. A flashlight mount is provided at the distal end of the extension arms. This mounting system is suitable for mounting a flashlight above a rifle scope, but does not provide a general purpose mount for different types of auxiliary equipment, Furthermore, this mounting system lacks positioning features necessary to attain accurate alignment with the rifle of auxiliary equipment such as laser markers or infrared imaging devices. It would also not be suitable for mounting some types of auxiliary equipment because it would position the auxiliary equipment above the rifle sight at a height that would make it difficult for a shooter to view a target through the auxiliary equipment. This system is also prone to misalignment between the flashlight and the rifle scope, which can result from failure of the mounting rings to properly fit onto the rifle scope.

U.S. Pat. No. 5,134,798 describes a sight mount that comprises a two-tier base bar. The base bar provides a rigid support for two mounting rails, which may include rails of the Picatinny or WEAVER type. This device eliminates a number of the shortfalls of the mounting system of U.S. Pat. No. 4,707,772 described above. However, because of the rigidity required, the mount must be formed of metal having a thickness that significantly increases the weight of the rifle and decreases its portability. A vertical member of the mount that connects the two tiers of the base bar limits the allowable length of sights or equipment mountable to the lower tier. Finally, the different longitudinal positions of the two tiers make it difficult for a shooter to use two aiming devices having the same eye relief distance.

SUMMARY OF THE INVENTION

An advantage of the invention is, therefore, to provide an aiming device that has integral universal mounting features allowing for easy mounting and removal of auxiliary equipment without requiring re-alignment of the aiming device after the auxiliary equipment is removed.

Another advantage of the invention is to provide such an aiming device having compact, integral mounting features that reduce the overall weight, height, complexity, part count, and manufacturing cost.

A further advantage of the invention is, therefore, to provide an aiming device for mounting to a firearm in which the height position of the aiming device above a firearm is easily adjustable in the field to accommodate different shooter head positions necessitated by the use of protective clothing or headgear, without requiring realignment of the sight with the firearm.

Yet another advantage of the invention is to provide an aiming device having an integral mounting portion formed thereon to eliminate misalignment problems.

These and other advantages of the invention are accomplished by an aiming device such as a telescopic sight that includes an elongate housing having integral exterior mounting channels and integral exterior auxiliary equipment mounting features formed of a one-piece construction. The housing includes an elongate mounting bar integrally formed therewith. The housing is sized to hold optical elements and electronics of the telescopic sight. Clamp assemblies cooperate with the mounting bar to secure the telescopic sight to the firearm and provide adjustment of the height position of the telescopic sight. Each clamp assembly includes two clamp blocks that are joined together by a bolt and nut assembly. The clamp blocks include cleats that are sized to fit in one of the first and second-side grooves and a heel portion that is sized to clamp about a Picatinny or WEAVER mounting rail.

The auxiliary equipment mounting features facilitate the mounting of multiple devices that allow the shooter to quickly alternate between or to simultaneously use multiple aiming devices for various uses, such as for short- and long-range use; laser marking devices; different types of telescopic sights; equipment for darkened situations, i.e., infrared imaging devices and high-intensity or strobe lights; and devices for range finding or other tactical purposes. Because the mounting features are universal and require little or no post-mounting adjustment to accurately align the auxiliary equipment, they allow a shooter to mount and remove auxiliary equipment in the field. The mounting features are positioned medially of the proximal and distal ends of the housing to facilitate the use of auxiliary equipment having an eye relief distance similar to that of the telescopic sight.

In the preferred embodiment, the telescopic sight includes windage and elevation adjustment knobs that extend from the housing transverse of the longitudinal axis. The windage and elevation adjustment knobs allow the shooter to manually adjust the lateral position of a reticle or an erector lens assembly contained within the housing to adjust for ballistic characteristics of the firearm, wind conditions, and the distance to the target. The windage and elevation adjustment knobs are sized to fit within recesses formed in the housing and the first and second sets of auxiliary mounting features, but are accessible through gaps in side edges of the mounting features so that auxiliary equipment, when mounted to the mounting features, does not interfere with the shooter's access to or the operation of the adjustment knobs.

In the preferred embodiment, the housing includes an internally threaded rim at the distal end for receiving screw-in filters for enhancing the target image viewed by the shooter. Such filters may include, i.e., polarizing filters for reducing glare, green filters for enhancing visibility of laser marking, and amber filters for increasing contrast in flat light conditions. The internally threaded rim is also sized to fit an infrared adapter or other night vision enhancing equipment.

Additional objects and advantages of this invention will be apparent from the following detailed description of preferred embodiments thereof, which proceeds with reference to the accompanying drawings.

BRIEF DESCRIPTION OF THE DRAWINGS

FIG. 1 is a partial side elevation view of a prior art M-16 rifle;

FIG. 2 is a cross sectional view of a handle of the M-16 rifle taken along line 2—2 of FIG. 1;

FIG. 3 is an eyepiece end and left side perspective view of a telescopic sight and two mounting clamp assemblies in accordance with the present invention;

FIG. 4 is an objective end elevation view of the telescopic sight of FIG. 3;

FIG. 5 is an eyepiece end elevation view of the telescopic sight of FIG. 3;

DETAILED DESCRIPTION OF PREFERRED EMBODIMENT

Figure 11:
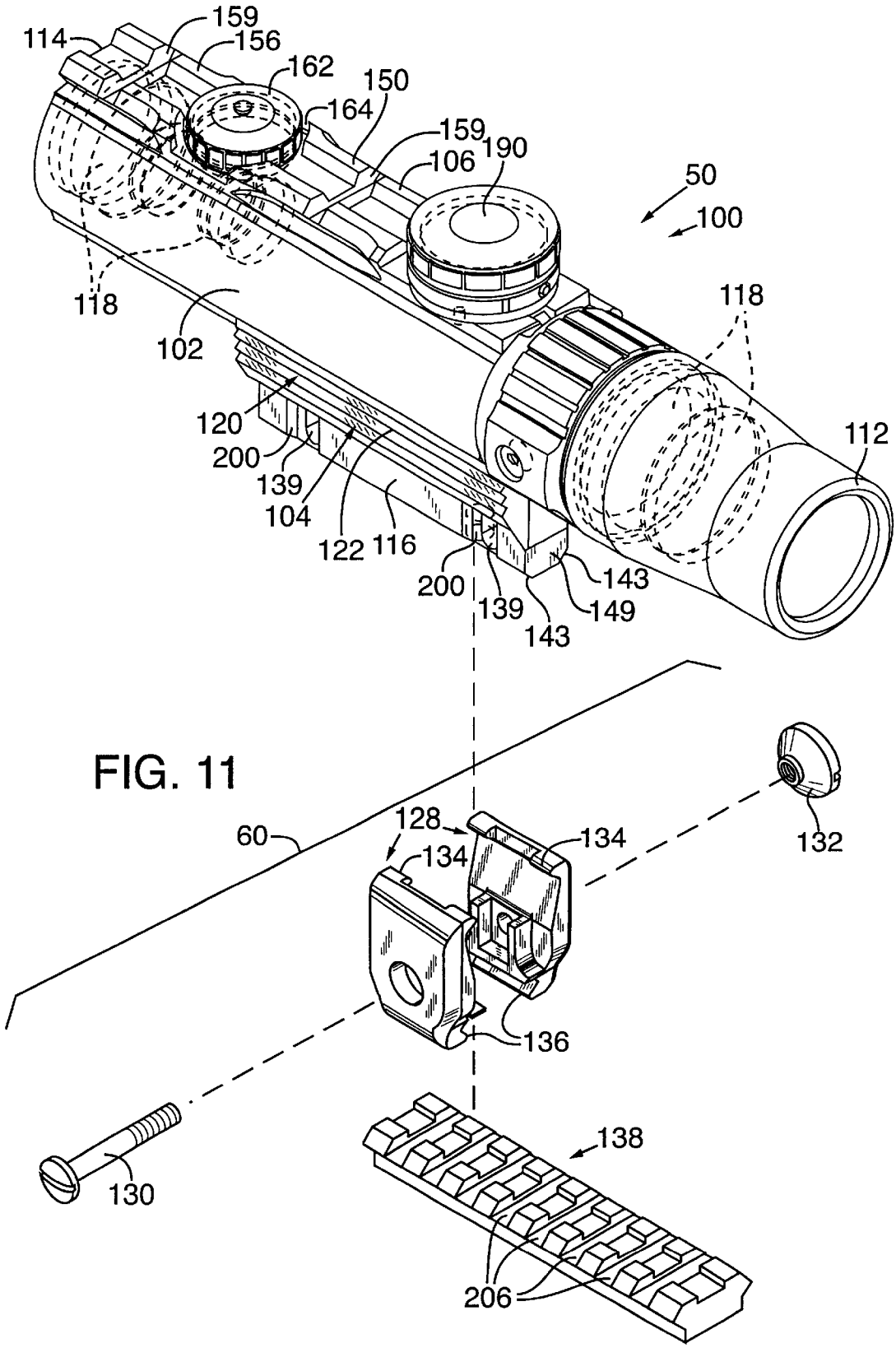
FIG. 11 is an exploded perspective view of the telescopic sight and mounting clamp assembly of FIG. 3 along with a Picatinny mounting rail.

FIG. 3 shows an aiming device 100 that represents a preferred embodiment of the present invention. With reference to FIG. 3, aiming device 100 includes a telescopic sight 50 and clamp assemblies 60 for mounting the telescopic sight 50 to a firearm. The aiming device 100, comprises a telescopic sight 50 in a first preferred embodiment, but alternatively may be embodied as another type of firearm aiming device such as, for example, a laser marker, range finder, or infrared imaging device. The aiming device 100 comprises a housing 102 with integral mounting channels 104 that cooperate with clamp assemblies 60 for mounting the telescopic sight 50 to the barrel of the firearm. The housing 102 includes integral mounting features 106 located on upper and side surfaces of the housing 102 for mounting multiple auxiliary equipment, such as, for example, devices for short- and long-range use, laser marking devices, different types of telescopic sights, infrared imaging devices, high-intensity or strobe lights, and devices for range finding or other tactical purposes. The mounting features 106 are universal and do not require post-mounting adjustment for accurate alignment and allow quick mounting and removal of the auxiliary equipment in the field. The housing 102 includes a tubular portion 108 (FIG. 4) that extends along a longitudinal axis 110 and has a proximal end 112 and a distal end 114. The housing 102 further has an integral mounting bar 116 that extends along a direction parallel to the longitudinal axis 110 for mounting the housing 102 to the barrel of the firearm. Optical elements 118, such as lenses, prisms, night-vision sensors, and reticles, may be provided to enhance viewing as seen in phantom in FIG. 11.

Figure 10:
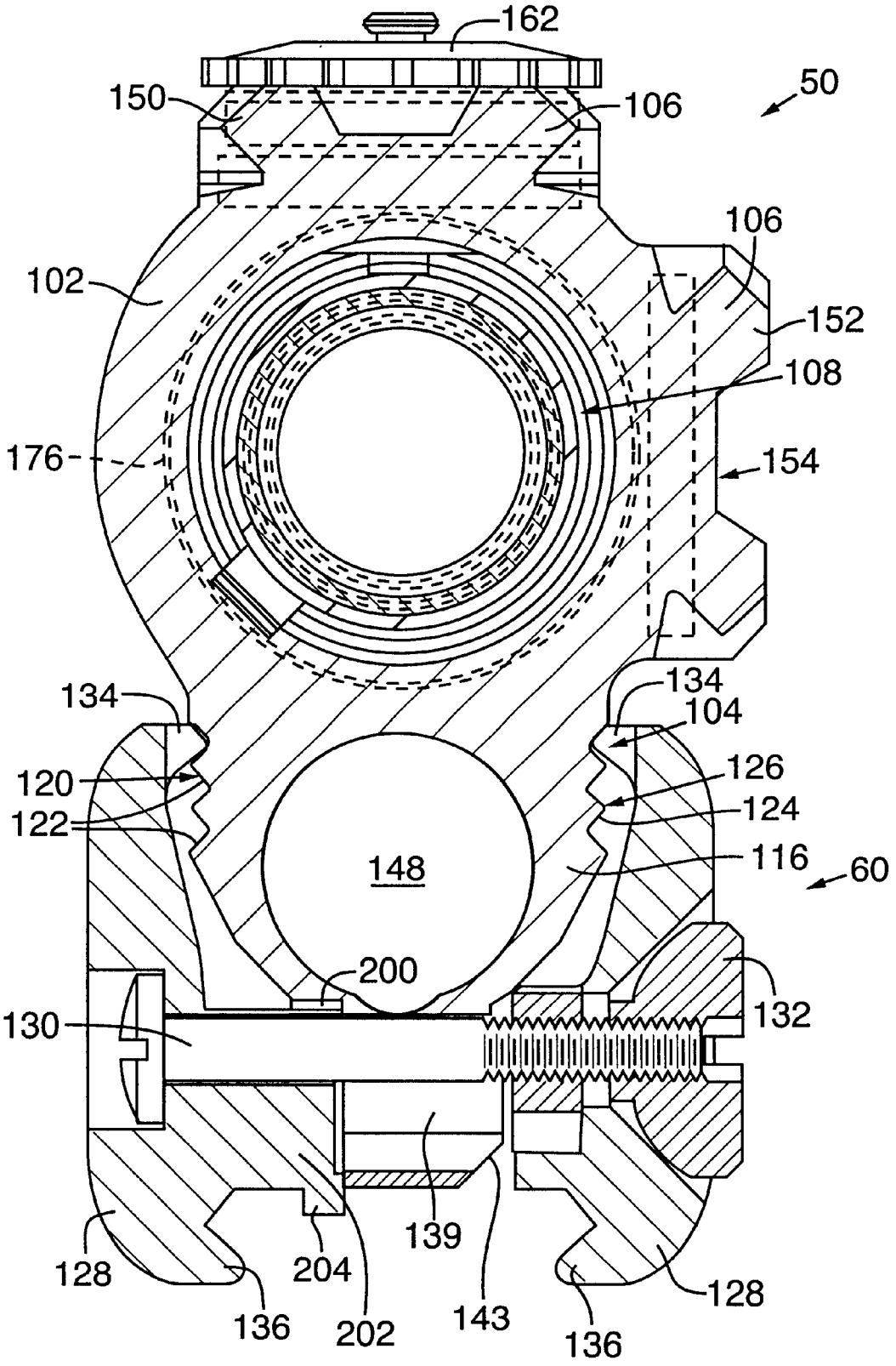
FIG. 10 is a cross sectional view of the telescopic sight taken along lines 10—10 of FIG. 6.

The mounting channels 104 are formed on the mounting bar 116. As seen most clearly in FIG. 10, the mounting bar 116 has a first surface 120 along one side on which is formed a mounting channel 104 made up of a first set of grooves 122. An opposed mounting channel 104 is made up of a second set of grooves 124 formed in a second surface 126 of the mounting bar 116. The grooves 122 and 124 are aligned with the longitudinal axis 110 and are spaced apart at incremental distances. The mounting channels 104 cooperate with the clamp assemblies 60 for mounting onto the firearm. The clamp assemblies 60 include opposed clamp blocks 128 that are connected by a bolt 130 and secured by a nut 132. Each of the clamp blocks 128 has a cleat 134 at one end that cooperatively engages one of the grooves 122 and 124 and a heel portion 136 formed on the opposite end thereof to operatively fit on a Picatinny or WEAVER mounting rail as seen at 138 in FIG. 11. The grooves 122 and 124 extend substantially parallel to each other so that the cleats 134 of the clamp blocks 128 may selectively engage opposed grooves 122 and 124 to adjust the telescopic sight 50 at different heights to accommodate different head positions. The mounting bar 116 has an elongated opening 139 (FIG. 10) through which the bolt 130 extends to allow for the adjustment without removal of the clamp assemblies 60 from the mounting bar 116. The elongated opening 139 extends in a direction transverse of the grooves 122 and 124 so that the height of the telescopic sight 50 above a firearm can be adjusted by moving it relative to the clamp assemblies 60 when the bolt 130 and nut 132 are loosened.

Figure 6:
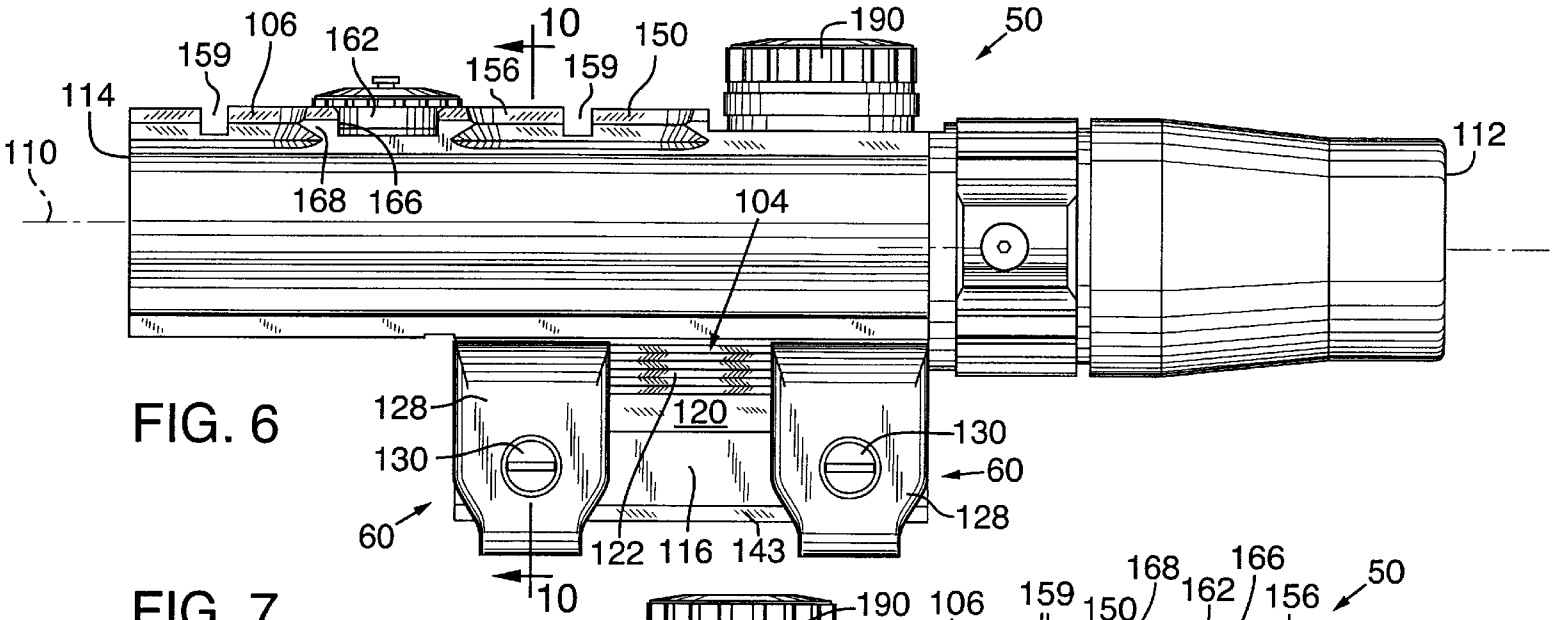
FIG. 6 is a left side elevation view of the telescopic sight of FIG. 3.
Figure 7:
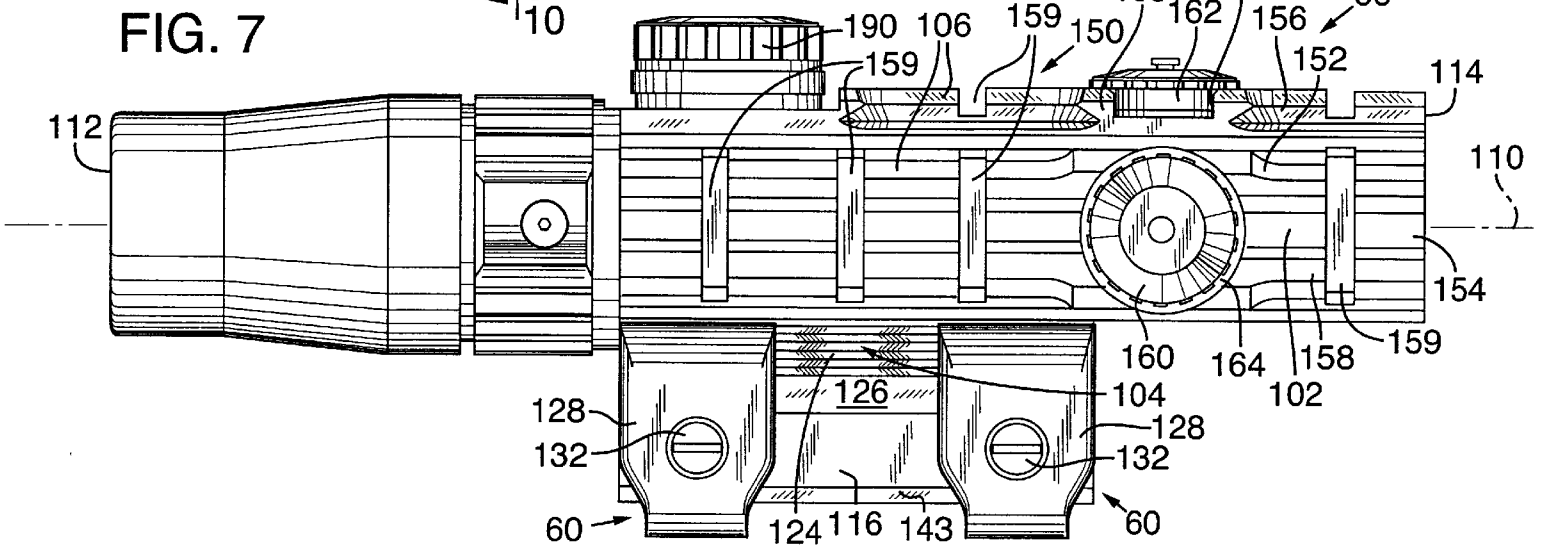
FIG. 7 is a right side elevation view of the telescopic sight of FIG. 3.
Figure 8:
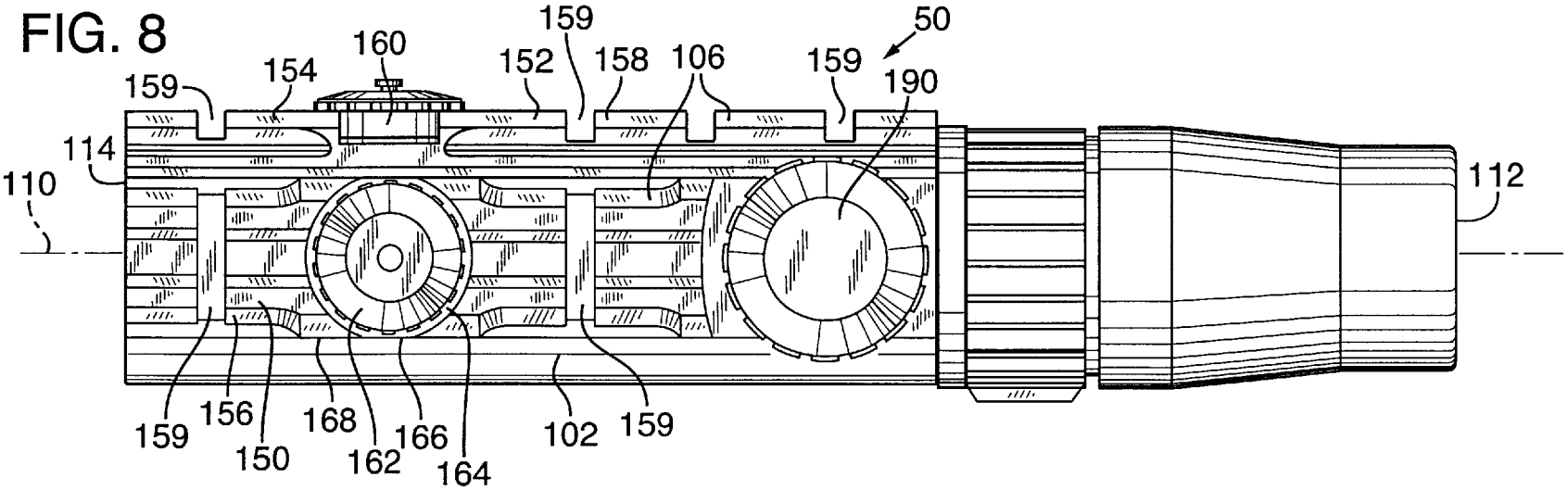
FIG. 8 is a top plan view of the telescopic sight of FIG. 3.
Figure 9:
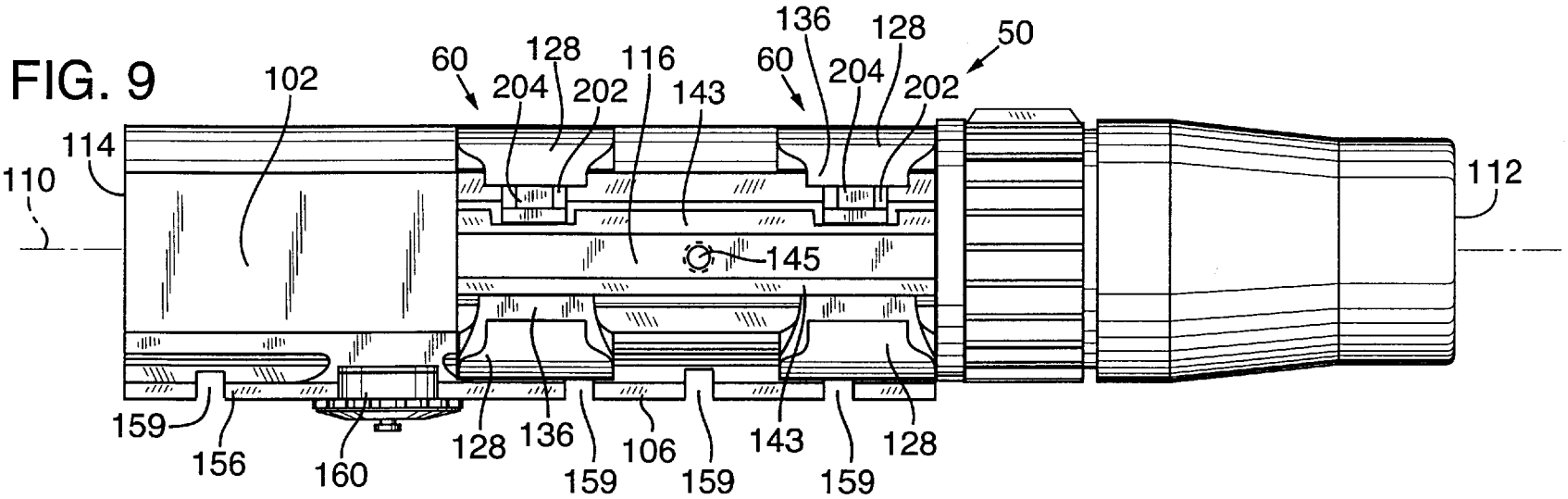
FIG. 9 is a bottom plan view of the telescopic sight of FIG. 3.

The telescopic sight 50 may be mounted to a standard handle of a military rifle 142 firearm as seen most clearly in FIGS. 1 and 2. The clamp assemblies 60 are simply removed to facilitate this mounting arrangement. Such a standard mounting may be found, for example, on older M-16 automatic and semiautomatic rifles of the type manufactured by Colt's Manufacturing, Hartford, Connecticut. Such a mounting may include a fold 140 formed in a handle 141 of the rifle 142. The lower end of the mounting bar 116 has chamfers 143 (FIGS. 4 and 5) that cooperate with fillets 144 (FIG. 2) in the fold 140. The mounting bar 116 further includes a threaded hole 145. (FIG. 9) in a bottom surface to receive a thumb screw (not shown) that extends through mounting hole 147 for securing the telescopic sight 50 to the rifle 142.

A cavity 148 is formed in the mounting bar 116 and extends through the mounting bar 116. The cavity 148 has several functions, one of which is to reduce the weight of the mounting bar 116. The telescopic sight 50 may be provided with battery terminals (not shown) for connection to, for example, AA-sized batteries, which are installed in the cavity 148 to provide power to electronic components or devices such as, for example, an illuminated reticle. A cover 149 (FIG. 11) may be provided to retain the batteries in the cavity 148.

The mounting features 106 include a first set of mounting guides 150 located on the upper surface of the housing 102 and a second set of mounting guides 152 located on one side surface 154 of the housing 102 for mounting auxiliary equipment on the housing 102. First and second sets of mounting guides 150, 152 include respective first and second dovetail rails 156, 158 each having one or more slots 159 formed therein and aligned transversely of longitudinal axis 110. The side of the housing occupied by the second set of mounting guides 152 is opposite the shooter's free eye so that auxiliary equipment mounted on the second set of mounting guides 152 will not obscure the unassisted view of the shooter through the free eye. It also allows the side of the housing 102 without mounting features to be made smooth so that it will not catch on the shooter's clothing when carrying the firearm and aiming device. The mounting guides 150 and 152 are located between the proximal end 112 and the distal end 114 of the housing 102 to facilitate use of auxiliary equipment having an eye relief distance similar to that of the aiming device 100. The telescopic sight 50 preferably includes a windage adjustment knob 160 and an elevation adjustment knob 162, which allow a shooter to manually adjust the lateral position of a reticle or an erector lens assembly contained within the housing 102. This allows for adjustment of the aim of the telescopic sight 50 to compensate for varying ballistic characteristics of the firearm, wind conditions, and distance to the target. The windage and elevation adjustment knobs 160 and 162 are sized to fit within recesses 164 formed in the housing 102 and are accessible through gaps 166 in side edges 168 of the mounting features 106.

The housing 102 also includes an internally threaded rim 176 (FIGS. 4 and 10) to receive screw-in filters for enhancing a target image. Such filters may include, for example, polarizing filters for reducing glare, green filters for enhancing visibility of laser marking, and amber filters for increasing contrast in flat ambient light conditions. The internal threaded rim 176 may also be sized to fit an infrared adapter or other night vision enhancing equipment.

An eyepiece tube 180 of telescopic sight 50 is rotatably mounted to housing 102 at the proximal end 112. Rotating the eyepiece tube 180 causes the optical power of telescopic sight 50 to be changed by adjusting the longitudinal position of one or more optical elements 118 within telescopic sight 50. Rotation may be accomplished manually or by a trigger-mounted switch that is coupled to an electronic motor (not shown) of the telescopic sight 50 for driving the eyepiece tube 180. A reticle control knob 190 is rotatably mounted to housing 102 for adjustment of the brightness of an illuminated reticle (not shown) of telescopic sight 50.

To prevent recoil from causing misalignment, the mounting bar 116 includes two recoil notches 200 (FIG. 10) sized to snugly receive a recoil tab 202 of the clamp assembly 60 that extends from one or more of the clamp blocks 128 so that recoil of the rifle will not cause telescopic sight 50 to move longitudinally relative to clamp blocks 128. Alternatively, the recoil tab 202 is formed in a specially-shaped nut (not shown) fitted on bolt 130. Clamp blocks 128 also include a mounting tab 204 that fits within one of a plurality of lateral rail notches 206 in Picatinny mounting rail 138 (FIG. 11) to prevent clamp blocks 128 from moving longitudinally during recoil of the rifle.

It will be obvious to those having skill in the art that many changes may be made to the details of the above-described embodiment of this invention without departing from the underlying principles thereof.

What is claimed is:

1. An aiming device detachably mountable to a firearm for aiding a shooter in aiming the firearm, comprising:

an elongate housing having a longitudinal axis;

multiple optical elements supported within the housing; and a set of auxiliary equipment mounting features integrally formed in the housing and suitable for mounting auxiliary equipment to the aiming device without interfering with the operation of the aiming device or the firearm when the aiming device is mounted to the firearm, the auxiliary equipment mounting features including a dovetail rail in alignment with the longitudinal axis of the housing.

2. The aiming device of claim 1, further comprising an adjustment knob extending from the housing in a direction transverse of the longitudinal axis.

3. The rifle scope of claim 2 in which the adjustment knob is sized and positioned so that it is manually operable when auxiliary equipment is mounted to the set of auxiliary equipment mounting features.

4. The aiming device of claim 1 in which:

the aiming device has an eye relief distance and the auxiliary equipment has an auxiliary eye relief distance; and the set of auxiliary equipment mounting features includes one or more slots formed in the dovetail rail, the slots being aligned transversely of the longitudinal axis and positioned at a location along the aiming device that allows the auxiliary equipment to be mounted on the aiming device such that the auxiliary eye relief distance corresponds to the eye relief distance of the aiming device, to thereby minimize the head movement of the shooter when using both the aiming device and the auxiliary equipment.

5. The aiming device of claim 1 in which the set of auxiliary equipment mounting features comprises multiple dovetail rails for mounting multiple auxiliary equipment units.

6. The aiming device of claim 5, further comprising a windage adjustment knob and an elevation adjustment knob, the windage and elevation adjustment knobs extending from the housing in a direction transverse of the longitudinal axis and sized so that they are manually operable when auxiliary equipment is mounted to the dovetail rails.

7. The aiming device of claim 6 in which the windage and elevation adjustment knobs are substantially recessed within the dovetail rails.

8. The aiming device of claim 1 in which the housing includes a smooth outer side surface to prevent the aiming device from snagging clothing worn by the shooter.

9. The aiming device of claim 1, further comprising an optical path and a set of threads formed in the housing and adapted for mounting an image enhancing attachment in the optical path.

10. The aiming device of claim 1 in which the aiming device is a rifle scope.

11. The aiming device of claim 1, further comprising an elongate mounting bar integrally formed in the housing and extending from the housing, the mounting bar positioned in alignment with the longitudinal axis for detachably mounting the aiming device to the firearm.

12. The aiming device of claim 1 in which the auxiliary equipment mounting features include first and second dovetail rails angularly spaced about the longitudinal axis and in alignment with the longitudinal axis.

13. The aiming device of claim 12 in which the first and second dovetail rails each includes at least one slot aligned transversely of the longitudinal axis.

14. The aiming device of claim 12 in which the first and second dovetail rails are spaced 90 degrees apart about the longitudinal axis.

* * * * *

UNITED STATES PATENT AND TRADEMARK OFFICE

CERTIFICATE OF CORRECTION

PATENT NO. : 6,295,754 B1
DATED : October 2, 2001
INVENTOR(S) : Rodney H. Otteman et al.

It is certified that error appears in the above-identified patent and that said Letters Patent is hereby corrected as shown below:

Title page, Item [54] and Column 1, lines 1 and 2,
Should read -- AIMING DEVICE WITH AUXILIARY EQUIPMENT MOUNTING FEATURES --

Column 3,
Line 17, "first and second-side" should read -- first- and second-side --.

Column 4,
Line 17, "lines" should read -- line --.

Signed and Sealed this

Twenty-sixth Day of August, 2003

JAMES E. ROGAN
*Director of the United States Patent and Trademark Office*